US005101976A

United States Patent [19]

Salisbury

[11] Patent Number: 5,101,976

[45] Date of Patent: Apr. 7, 1992

[54] SHIPPING LOG FOR COMPONENTS

[76] Inventor: John W. Salisbury, 31746 Staman Cir., Farmington, Mich. 48018

[21] Appl. No.: 445,389

[22] Filed: Dec. 4, 1989

[51] Int. Cl.[5] ..... B65D 85/48

[52] U.S. Cl. ..... 206/454; 206/449; 206/453; 206/523; 206/586

[58] Field of Search ..... 206/449, 454, 453, 588, 206/586, 523; 220/22.3; 211/41

[56] References Cited

U.S. PATENT DOCUMENTS

| | | | |
|---|---|---|---|
| 2,337,468 | 12/1943 | Hilger | 206/454 |
| 2,919,022 | 12/1959 | Lidgard . | |
| 2,931,116 | 4/1960 | Boughton et al. | 206/454 |
| 2,953,253 | 9/1960 | Henderson et al. . | |
| 2,984,399 | 5/1961 | Gaulke | 206/454 |
| 3,043,488 | 7/1962 | Warwick . | |
| 3,133,687 | 5/1964 | Fremion . | |
| 3,147,860 | 9/1964 | Kean et al. . | |
| 3,344,916 | 10/1967 | Brueckner | 206/453 |
| 3,362,609 | 1/1968 | Freedy . | |
| 3,385,462 | 5/1968 | Deldime et al. . | |
| 3,403,778 | 10/1968 | Voytko et al. . | |
| 3,414,124 | 12/1968 | Lidgard . | |
| 3,559,866 | 2/1971 | Olson, Sr. | 206/453 |
| 3,653,496 | 4/1972 | Roberts et al. . | |
| 3,695,669 | 7/1973 | Lidgard | 206/454 |
| 3,809,234 | 5/1974 | Kurick . | |
| 3,938,660 | 2/1976 | Moehring . | |
| 3,948,436 | 4/1976 | Bambara . | |
| 3,973,720 | 8/1976 | Schmid . | |
| 3,995,738 | 12/1976 | Rowley et al. . | |
| 4,051,549 | 9/1977 | Fiege | 361/399 |
| 4,053,049 | 10/1977 | Beauvais | 206/318 |
| 4,182,450 | 1/1980 | Kryger | 206/448 |
| 4,202,452 | 5/1980 | McCormick | 211/41 |
| 4,209,091 | 6/1980 | Lieberman | 206/333 |
| 4,225,043 | 9/1980 | Lastik | 206/448 |
| 4,240,240 | 12/1980 | Cohen | 53/418 |
| 4,287,990 | 9/1981 | Kurick | 206/448 |
| 4,315,711 | 2/1982 | Koscho | 414/97 |
| 4,317,517 | 3/1982 | Tisdale | 206/597 |
| 4,353,466 | 10/1982 | Pater | 206/453 |
| 4,368,822 | 1/1983 | Kramer et al. | 211/41 |
| 4,413,735 | 11/1983 | Little | 206/523 |
| 4,489,835 | 12/1984 | Tombal et al. | 211/41 |
| 4,545,482 | 10/1985 | Novatny | 206/320 |
| 4,805,774 | 2/1989 | Salisbury | 206/454 |

*Primary Examiner*—David T. Fidei

*Attorney, Agent, or Firm*—Gifford, Groh, Sprinkle, Patmore and Anderson

[57] ABSTRACT

A shipping log for supporting components which cannot be supported on edge, such as an automotive lite having a gasket mounted on a peripheral edge of the lite. The shipping log has a plurality of slits or gaps positioned to accept the bottom portions of components and a plurality of fingers having surfaces for mating with the component to maintain the position of the components. The support log is formed of a body having a rigid frame and a smooth outer surface formed of resilient closed-cell-poly-linked foam.

13 Claims, 2 Drawing Sheets

SHIPPING LOG FOR COMPONENTS

BACKGROUND OF THE INVENTION

I. Field of the Invention

This invention relates to a shipping log for transporting and supporting components, and more particularly, for a shipping log for shipping industrial parts such as windows, doors, bumpers for cars and the like in a vertical alignment.

II. Description of the Prior Art

Many components for machinery and automobiles require special handling in shipping. Components such as doors, inner door structures, bumper facias, windshields, must be carefully shipped in order to preserve the finish. Many of these parts cannot rest on an end or an edge because of the product configuration and must be supported at an intermediate position. Additionally, products must be supported in such a manner as to maintain the components in a secure position within the shipping containers while preventing damage to the components.

Heretofore, metal racks having adjustable components or specially manufactured crates with special dunnage have been molded or fabricated. Frequently, special attachments must be manufactured for each product to be shipped. In some cases, components are shipped in crates having specially formed dunnage such as foam blocks or cardboard strips to transport the components.

After use, the large metal racks must be shipped back to the manufacturing site for reuse and the components reassembled to support the product. In the case of crates using specially molded dunnage, the dunnage must be discarded requiring disposal facilities, as well as the additional expense of using new crates and dunnage for the shipping of new materials.

Shipping devices for transporting lites, are known such as U.S. Pat. No. 4,225,043 to Lastic which discloses folding a resilient compressible pad over an edge portion of a sheet of glass and wedging the folded pad and sheet into slots of a pair of elongated logs of a shipping container. The pad is thus compressed within the slot to apply a biasing force to hold the sheet securely in position against longitudinal movement within the shipping container during transportation. Lastic, alternatively discloses lining each slot of the log with a resilient pad prior to insertion of the sheet into the slot.

My prior patent, U.S. Pat. No. 4,805,774, discloses a shipping log having a plurality of vertical slots to maintain the sheet members in a spaced apart vertical alignment and a resilient formable strip extending across a plurality of grooves and deformable into the grooves under the weight of the sheet member to prevent longitudinal displacement of the sheet members.

Automotive lite manufacturers are now installing gaskets on the lites prior to shipment to the automotive manufacturer. Known shipping containers for lites are unusable for shipping windshields with attached gaskets. It is necessary to support the windshields so that the flange of the gasket does not become kinked or distorted. Such kinking and distortion may result in making the gasket unusable in the automobile. Thus, it is necessary to support a windshield in such a position that the gasket and flange are not kinked or marred. Previously known support logs do not support the windshield in such a fashion as to prevent kinking or distortion of the flange.

Thus, it would be desirable to provide a shipping device for shipping and storage of parts in a vertical alignment, not only in order to save space while not supporting the weight of the workpiece on the bottom edge of the device. Additionally, it would be desirable to provide a device which is inexpensive to produce and may be reused.

Additionally, it would be advantageous to provide shipping devices which prevent distortion or damage to the surfaces of the parts, may be adaptable for a variety of shipping containers and parts.

SUMMARY OF THE PRESENT INVENTION

In order to overcome the above problems and disadvantages of known devices, this invention relates to a support log for storage and transportation of components which are not capable of being supported on edge or bottom surface when in a vertical alignment. Examples of such products are an automotive lite having a gasket in place about the peripheral edge of the lite, or interior door components. The shipping log is provided with a frame having a plurality of arms defining slits having a predetermined width for accepting the end or bottom edge of the product freely within. A portion of each end of the arm forms a shelf to engage an intermediate portion of the product. The frame is rigid and covered with a smooth resilient outer surface or covering of cross-linked-closed-cell foam.

BRIEF DESCRIPTION OF THE PREFERRED EMBODIMENTS

Figure 1:
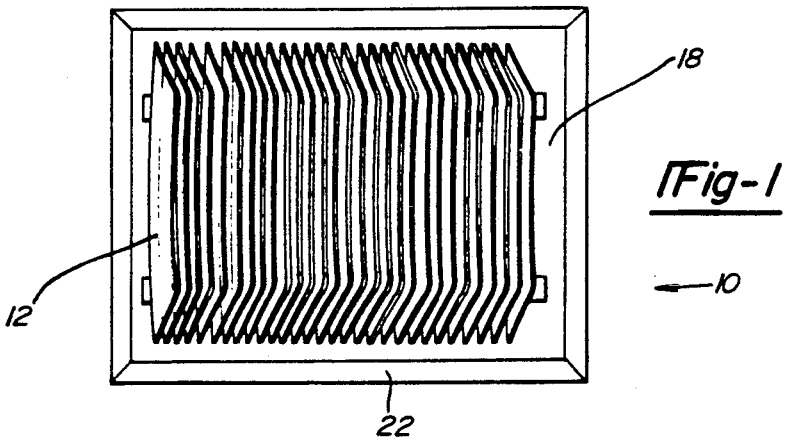
FIG. 1 is a top view of a container loaded with automotive lites supported by a support log in accordance with the invention.
Figure 2:
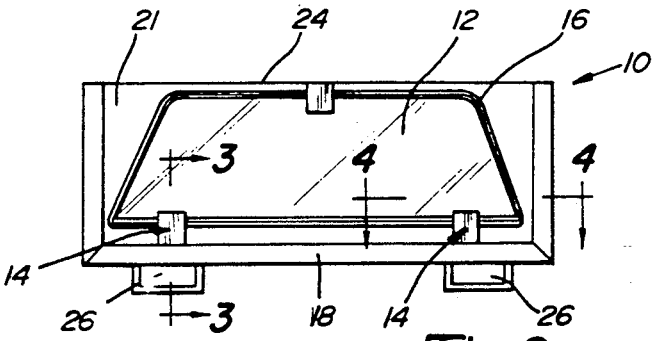
FIG. 2 is a front view of the container having a panel removed to show an automotive lite and gasket in position within the container.

Shown in FIGS. 1 and 2 is a container 10 for transporting and storing a plurality of sheets for automotive lites 12 such as windshields in a shipping log 14. Each lite is provided with a gasket 16. The container 10 is used for shipping a plurality of lites from a manufacturer to an automobile manufacturer for assembly in an automobile (not shown).

When lites are needed for assembly, the container 10 is placed on a conveyor (not shown) to travel to a work station where the lites 12 are removed from the container 10 for installation in an automobile.

As shown in FIGS. 1 and 2, the container has a base 18, side panels 20, a back panel 21, a front panel 22 (not shown in FIG. 2), and a top panel 24. The base 18 includes a pair of runners 26 to provide clearance for lifting of the container with a fork truck. The container 10 may be formed of any suitable material such as wood, as shown in FIGS. 1 and 2, pressed corrugated fiberboard, or the like.

The front panel 22 and top panel 24 can be easily removed for packing and access to the window lites. The number of lites which are packed in the container depend upon the curvature of the lites and is typically between 8 and 14 lites.

Figure 3:
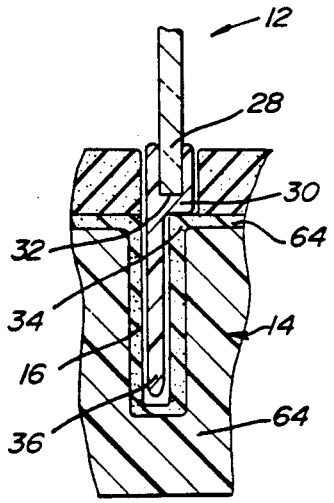
FIG. 3 is a partial sectional view of a log containing a lite and gasket taken along lines 3—3 of FIG. 2.

As best shown in FIG. 3, the gasket 16 is mounted along a peripheral edge 28 of each lite 12. The gasket 16 has a U-shaped cup portion 30 having a center slot 32 for receiving the peripheral edge 28 of the lite. Extending beneath the center slot 32 is a shoulder 34 and a flange 36. The generally elongated flange 36 extends outwardly from the lite. The gasket 16 is typically formed of a synthetic rubber. The flange 36 may be formed in a variety of configurations, shapes and sizes to conform to the dimensions of the automobile in which it is to be inserted. The flange as shown in FIG. 3 extends generally coplanar with the lite. However, some flanges may extend at an anqle to the plane of the lite or may be curved in an arc.

Figure 5:
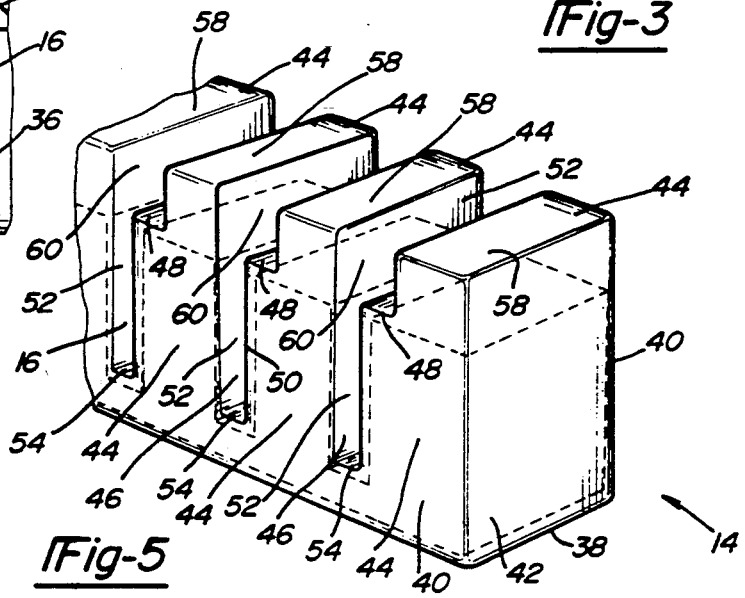
FIG. 5 is a partial perspective view of a log according to the invention.
Figure 6:
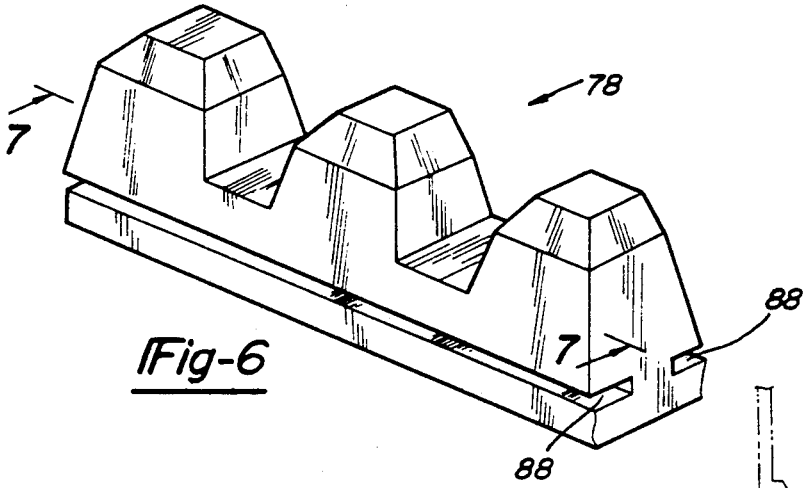
FIG. 6 is a perspective view of the frame for an alternative embodiment of a support log.
Figure 8:
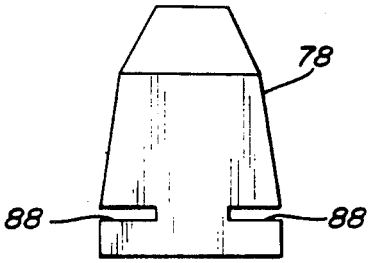
FIG. 8 is an end view of the frame of the alternative embodiment of the invention.

The support log 14, as best shown in FIG. 5, is a generally rectangular cross-section with a bottom surface 38 and a pair of side surfaces 40 extending between a pair of end surfaces 42.

A plurality of arms 44 extending outwardly in a direction away from the bottom surface 38 are separated by a plurality of slits 46 extending downwardly from the top surface. Each arm has an end or shelf portion 48 extending from a front wall 50 and a back wall 52. The front wall 50 of one arm and the back wall 52 of an adjacent arm being spaced apart a predetermined distance to form each slit 46 for accommodating the flange 36 of the gasket 16. A lower surface 54 extends between the two walls forming the slit. As shown in FIG. 5, each slit 46 extends generally normal to the bottom portion. However, the slits 46 may be angled or be curved as necessary to accommodate the flange. Each slit 46 is dimensioned to freely accept the flange 36 of the gasket 16 within the slit so as to prevent kinking of the gasket. A partition 58 is mounted on the end portion of each arm. Between each pair of partitions is a groove 60. Each groove 60 extends above a respective slit and shelf 56. Each groove 60 is dimensioned to accept the cup portion 30 of the gasket 16.

The shoulder 34 of the gasket is supported on the shelf 48 of the arm. The width of the groove 60 is slightly narrower than the width of the cup 30 of the gasket 16 so that the gasket is frictionally secured within the groove to prevent transverse movement of the lites.

Figure 4:
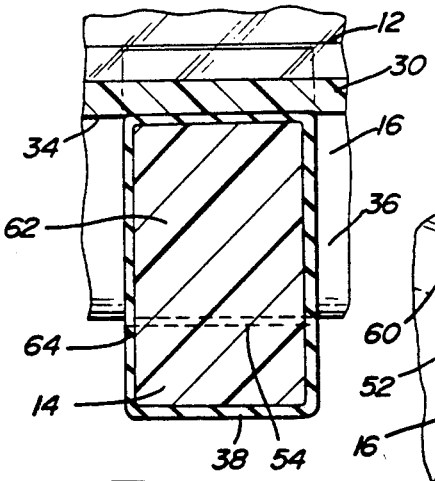
FIG. 4 is a partial sectional view of a log and window lite and gasket taken along lines 4—4 of FIG. 2.

As best shown in FIG. 4, the log is formed of a rigid inner frame 62 having a coating 64 of resilient material. The partition 58 is likewise formed of a resilient material. The frame is formed in the same general shape of the support log. The frame may be constructed of any suitable rigid material such as wood, plastic, metal or composite which is able to support the weight of the windshield on the shelf 56 of the arm.

The coating 64 and partition 58 are formed of a cross-linked polyethelene (CLPE) foam. The density of the foam is in the range of 8 psi and the density of foam used for window lites is 2 to 4 pounds. As is known in the art, the coating 64 is bonded to the frame in a mold (not shown). The frame is mounted in an aluminum mold and closely surrounded by die cut pieces of CLPE. The pieces of CLPE are formed to fit a cavity between the mold and the frame. As is known in the art, the mold is heated to approximately 400° for two and a half minutes. The heat causes the CLPE to flow and bond to the frame. The temperature is varied directly in relationship to the density and thickness of the foam. This results in application of a smooth resilient outer surface coating on all surfaces of the log except the bottom surface 38. The smooth resilient surface coating thus prevents marring, scratching of the gasket.

The partition 58 is molded to the ends of the support log in the same process, however, the partition may be formed of a foam of a different density. In order to firmly support the lite, a CLPE having a greater density than the CLPE for the sides may be used.

As shown in FIGS. 1 and 2, a pair of logs 14 are spaced apart on the base of the container 10 to support the lites 12. Each lite is lowered into the support log so that the flange 36 of the gasket 16 is accepted within the respective slits of the pair of support logs. The lite is lowered until the shoulder of the gasket 36 rests on the shelf 56 of the arm. The partitions are compressed to frictionally and biasingly secure the lite 12 within the groove. After the lites have been loaded into the bottom support logs one or two additional support logs 66 are positioned along the top edges of the lites to provide further support to maintain the lites in a vertical position during shipment. The top panel 24 and the front panel 22 of the container 10 are then installed on the container. The panels of the container are wired or banded together. The container is now ready for shipment.

Figure 9:
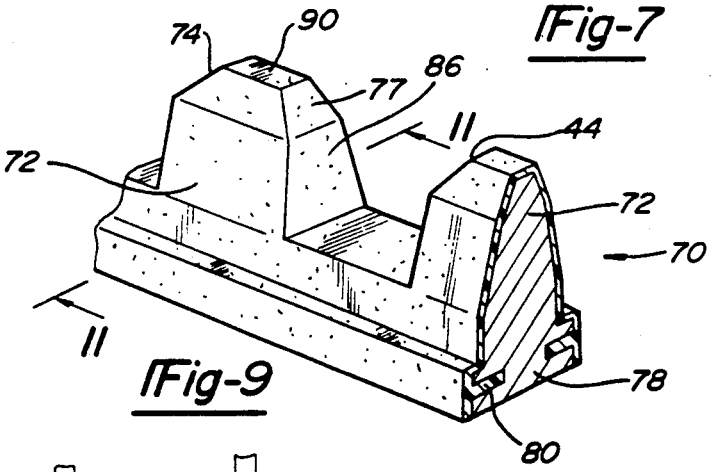
FIG. 9 is a partial perspective cross-sectional view of an alternative support log showing the frame and outer coating.

An alternative embodiment of the invention is shown in FIG. 9. A support log 70 having arms 72 with angled end surfaces 74 for supporting products which cannot be supported on a bottom edge, such as a finished inner panel 76 for an automobile door.

As shown in FIG. 9, the support log 70 is formed with a frame 78 and a coating 80 of CLPE foam in the same manner as disclosed for the embodiment forth above. A foam having a density of approximately 8 lb. is used for the coating.

Figure 7:
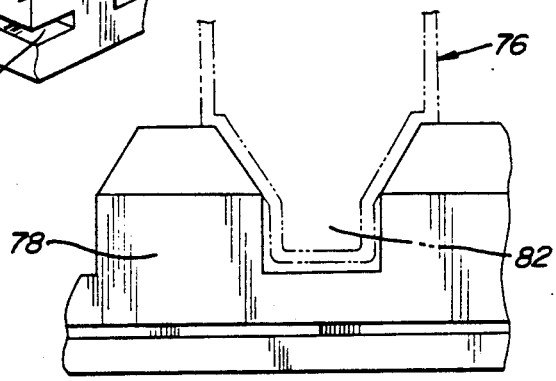
FIG. 7 is a partial side view of the alternative embodiment of a support log shown supporting a core of an automobile door.
Figure 10:
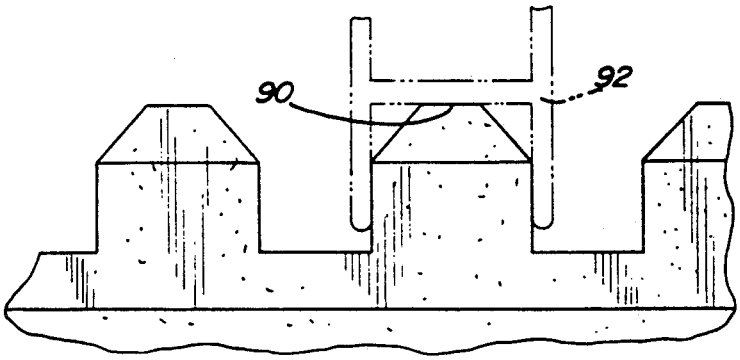
FIG. 10 is a partial cross-sectional view of the alternative embodiment of the support log taken along lines 10—10 of FIG. 9.

As best shown in FIG. 7, the support log 70 has a plurality of arms 72 spaced apart to form a space to receive a lower end 82 of the panel within. The arms are spaced apart to form a U-shaped gap having a bottom surface 84 extending between a pair of side walls 86. The angled end surfaces 74 of the arms extend from the side walls 86 to mate with similarly shaped and angled portions of the inner panel 76 of the automobile door. A pair of inwardly extending longitudinal slots 88 are formed on either side of the frame of the support log for receiving a portion of the coating of CLPE foam within, as shown in FIG. 9. The slits facilitate bonding of the coating to the frame. In this way, the end 82 of the panel is suspended within the gap. The panel is suspended and held in position by the angled end surfaces of the arms. As shown in FIG. 10, an H-shaped component 92 is supported on a top surface 90 of an arm.

The panels are loaded, as above, on two parallel support logs 70 in a crate. Additional support logs are positioned between the panels and the sides of the crate to maintain the panels in a vertical alignment. The support logs are not positioned on top of the panels as with the window lites because it is common to stack several crates on top of each other and the weight of the crates directed through support logs could damage the upper ends of the panels.

When the manufacturer wishes to unload the container, the container is placed upon a conveyor and the top panel, front panel, and the side support logs are removed. The product is now accessible for removal from the container at such time as needed for assembly or use.

It is understood that the forms of the invention herein shown described may be taken as preferred embodiments only, and that various changes in shape, size, and arrangement may be referred to without departing from the spirit of the invention.

I claim:

1. A device for storage and transportation of a sheet member having a gasket attached thereto, said gasket comprising a channelled region having a U-shaped channel defined therein and a flange portion depending from said channelled region, said sheet member having an outer periphery, said outer periphery being disposed in said channel of said channelled region, said device comprising:

an elongated rigid body having a plurality of spaced apart arms defining a plurality of gasket-receiving slits therebetween, each of said plurality of arms having an end portion; and a resilient partition extending from each of said plurality of arms, said partition having a ledge defined thereon, said partition further being spaced apart from an adjacent partition to define a groove, whereby said channelled region of said gasket is supported by said ledge.

2. The device of claim 1, wherein each said slit is formed to accept said flange portion of said gasket freely within.

3. The device of claim 1, wherein said groove is formed between a pair of walls of adjacent partitions, said pair of walls spaced apart a predetermined distance slightly smaller than the width of said cup portion of frictionally engage said cup portion.

4. The device of claim 3, wherein a portion of said end extends from one of said pair of walls to form a shelf for supporting said gasket and sheet member.

5. The device of claim 1, wherein said body comprises a rigid frame and a resilient coating.

6. The device of claim 5, wherein said resilient coating is formed of a closed-cell-cross-linked foam.

7. The device of claim 6, wherein said partition is formed of a resilient closed-cell-cross-linked foam.

8. The device of claim 7, wherein said coating and said partition are formed in a mold.

9. The device of claim 4, wherein said shelf extends in a direction normal to said one of said pair of walls.

10. A device for storage and transportation of a sheet member having a gasket attached thereto, said gasket comprising a channelled region having a U-shaped channel defined therein and a flange portion depending from said channelled region, said sheet member having an outer periphery, said outer periphery being disposed in said channel region, said device comprising:

an elongated rigid body having a plurality of spaced apart arms defining a plurality of gasket-receiving slits therebetween, each of said plurality of arms having an end portion;

each said slid being formed to accept said flange portion of said gasket freely within; and a resilient partition extending from each of said plurality of arms, said partition spaced apart from an adjacent partition to define a groove, whereby each of said arms supports a gasket.

11. A device for storage and transportation of a sheet member having a gasket attached thereto, said gasket comprising a channelled region having a U-shaped channel defined therein and a flange portion depending from said channelled region, said sheet member having an outer periphery, said outer periphery being disposed in said channel region, said device comprising:

an elongated rigid body having a plurality of spaced apart arms defining a plurality of gasket-receiving slits therebetween, each of said plurality of arms having an end portion;

said groove being formed between a pair of walls of adjacent partitions, said pair of walls spaced apart a predetermined distance slightly smalled than the width of said channelled region to frictionally engage said channelled region;

a resilient partition extending from each of said plurality of arms, said partition spaced apart from an adjacent partition to define a groove, whereby each of said arms-supports a gasket.

12. The device of claim 11, wherein a portion of said end extends from one of said pair of walls to form a shelf for supporting said gasket and sheet member.

13. The device of claim 12, wherein said shelf extends in a direction normal to said one of said pair of walls.

* * * * *

UNITED STATES PATENT AND TRADEMARK OFFICE

CERTIFICATE OF CORRECTION

PATENT NO. : 5,101,976

DATED : April 7, 1992

INVENTOR(S) : John W. Salisbury

It is certified that error appears in the above-identified patent and that said Letters Patent is hereby corrected as shown below:

Column 6, claim 10, line 22, "slid" should read --slit--.

Column 6, claim 11, line 41, "smalled" should read --smaller--.

Signed and Sealed this

Third Day of August, 1993

Michael K. Kirk

*Attest:*

MICHAEL K. KIRK

*Attesting Officer*

*Acting Commissioner of Patents and Trademarks*